United States Patent [19]

Izuta

[11] 3,942,506

[45] Mar. 9, 1976

[54] DEMOUNTABLE ARCHERY BOW

[75] Inventor: Tadao Izuta, Hamamatsu, Japan

[73] Assignee: Nippon Gakki Seizo Kabushiki Kaisha, Hamamatsu, Japan

[22] Filed: June 20, 1974

[21] Appl. No.: 481,403

[52] U.S. Cl. ..... 124/24 R; 124/30 R

[51] Int. Cl.[2] ..... F41B 5/00

[58] Field of Search ..... 124/23 R, 24 R, 30 R, 25, 124/22, 30 A, 52; 279/79, 85

[56] References Cited

UNITED STATES PATENTS

| | | | |
|---|---|---|---|
| 2,476,762 | 7/1949 | Petre et al. | 279/79 X |
| 2,522,388 | 9/1950 | Madsen | 279/79 X |
| 2,562,462 | 7/1951 | Jackson | 124/52 |
| 2,580,930 | 1/1952 | Kost | 279/79 |
| 2,958,552 | 11/1960 | Vosbikian et al. | 279/79 X |
| 2,972,493 | 2/1961 | Waters | 279/79 X |
| 3,415,240 | 12/1968 | Bear | 124/23 R |
| 3,628,519 | 12/1971 | Hofmeister | 124/24 R |
| 3,695,248 | 10/1972 | Izuta | 124/24 R |
| 3,814,075 | 6/1974 | Hoyt | 124/24 R |

*Primary Examiner*—Anton O. Oechsle
*Assistant Examiner*—William R. Browne
*Attorney, Agent, or Firm*—Haseltine, Lake & Waters

[57] ABSTRACT

A demountable archery bow with a handle provided at the opposite ends thereof with limb receiving means, and limbs to be removably inserted in the respective limb receiving means. A click stop mechanism is provided between each limb receiving means and the associated limb to facilitate the assembly and disassembly of the handle and limbs. The click stop mechanism may have a recess formed on the limb side in a manner to open in a direction perpendicular to that in which the limb is inserted in the limb receiving means, and a spring biased ball provided on the handle side, the ball being received in the recess under the spring biasing force when the limb is inserted in the handle and the ball being forcedly removable from the recess when a force pulling the limb away from the handle is exerted on the limb.

4 Claims, 8 Drawing Figures

DEMOUNTABLE ARCHERY BOW

BACKGROUND OF THE INVENTION

This invention relates to demountable or takedown archery bows of the type comprising a handle and limbs and capable of ready assemblage and disassemblage. More particularly, the invention concerns a demountable archery bow, in which a click stop mechanism is provided between a limb receiving means provided at each end of the handle and the limb received in the limb receiving means to insure simple and reliable assemblage and disassemblage of the handle and limbs.

Demountable archery bows in the prior art have had cumbersome latching arrangements. In a typical prior-art demountable archery bow, the handle and limb is joined together by screwing a bolt into a threaded bore formed in the handle and a bolt reception bore formed in the limb. This operation is very cumbersome because of the need for a tool for fastening the bolt (such as a screw driver), and it is also quite time-consuming. Also, this method of coupling encounters serious problems with respect to mechanical strength since the bolt reception bore is formed across the limb whose thickness and width dimensions are comparatively small. Besides, the limb portion surrounding the bolt reception bore is very prone to rupture since it inevitably experiences concentrated stress.

BRIEF SUMMARY OF THE INVENTION

The primary object of the present invention is to insure simple and reliable assemblage and disassemblage of the handle and limbs of an improved archery bow by providing a detent or click stop mechanism between a limb receiving means provided at each end of the handle and the limb received in the limb receiving means.

A further object of the invention is to provide a plate spring disposed on a limb, thereby insuring rigid and stable coupling of the limb to the handle, as well as absorbing vibrations produced at the time of shooting the arrow, that is, giving added stability to the bow.

Still a further object of the invention is to increase the rigidity and stability of coupling between handle and limb by providing a plate spring on the side of either limb receiving portion or limb.

The above and further objects, features and advantages of the invention will become more apparent from the following description taken in conjunction with the accompanying drawings.

DESCRIPTION OF THE PREFERRED EMBODIMENTS

Figure 1:
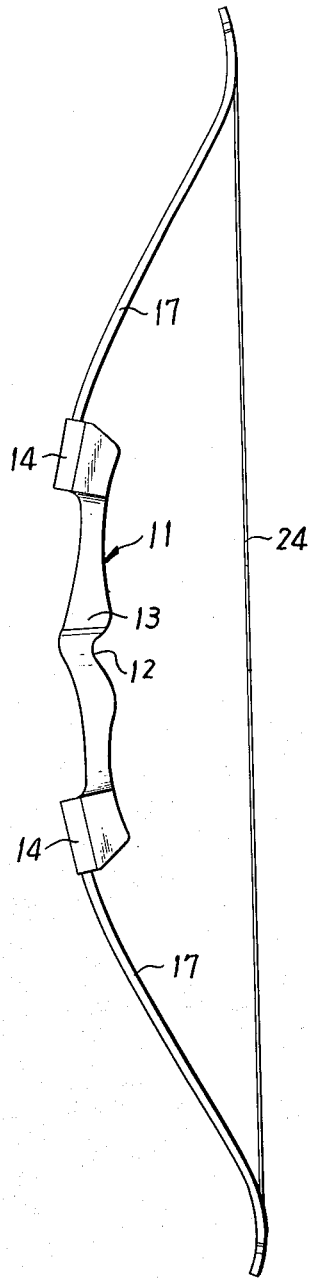
FIG. 1 is a side view showing an embodiment of the demountable archery bow according to a invention.

FIG. 1 is a side view of a demountable archery bow according to the invention. Element at 11 is a handle, which has a grip portion 12 and an arrow rest 13 for supporting an arrow (not shown). The handle 11 is provided at each end on the front or target side thereof with a limb receptacle 14 secured to the handle as by screws 15 (see FIG. 3). The limb receptacle 14 is a rectangular hollow body made of a material such as an aluminum alloy and is open at one end for insertion of the limb. Each limb 17 may be removably received in the corresponding space 16 defined by the associated limb receptacle 14.

Figure 2:
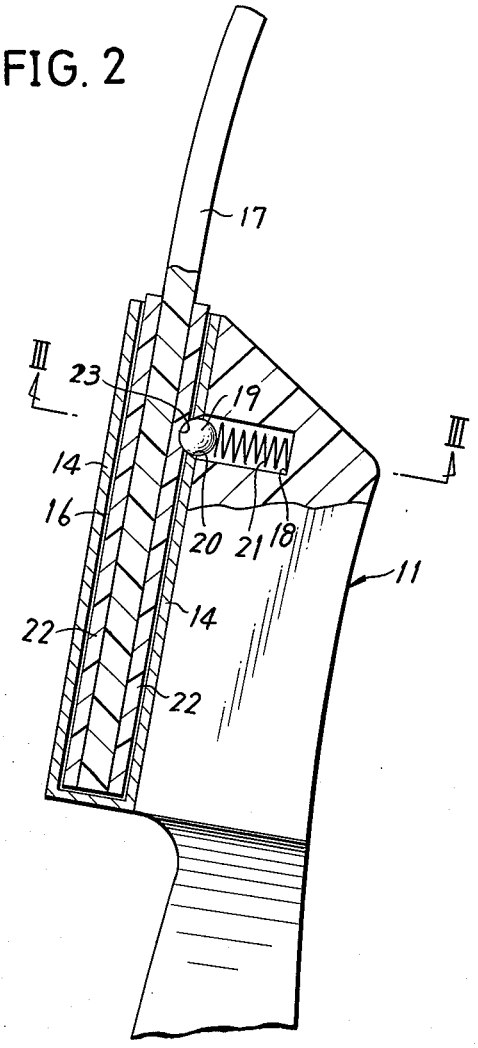
FIG. 2 is a sectional view, on enlarged scale, showing the juncture between limb and handle of the bow of FIG. 1.
Figure 3:
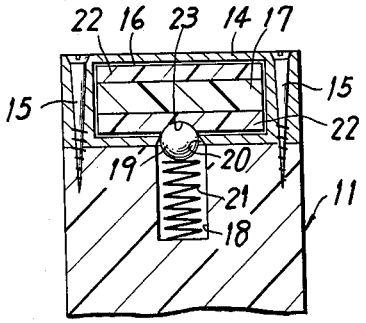
FIG. 3 is a sectional view taken along line III—III in FIG. 2.

FIGS. 2 and 3 show, on enlarged scale and in sectional views, the juncture between the limb and handle end. The opening 18 is a blind bore formed in the handle. It is open to the front or target side and may be as deep as is desired. Movably fitted in the blind bore 18 is a ball 19, which is spring biased by a spring 21 disposed within the blind bore 18 such that it penetrates a seat aperture 20 formed in the corresponding side wall of the limb receptacle 14 and projects into the limb reception space 16 thereof, thus constituting a detent mechanism or click stop mechanism.

The insertable end of each limb 17 is provided on both front and rear sides with synthetic resin pads or protectors 22 applied thereto. The pad 22 on the rear or face side is formed at a position corresponding to the ball 19 with a semi-spherical click stop recess 23. When the limb 17 is inserted into the limb reception space 16 to a predetermined extent, it is locked therein due to the ball 19 which is forced into engagement with the recess 23. Element 24 is a string stretched between the free ends of both the limbs 17 for known purposes.

It will be noted that when the insertable end of the limb 17 is inserted into the limb reception space 16 for assembling the archery bow, the ball 19 is first pushed into the blind bore 18 against the spring biasing force by the pad 22 provided on the rear or face side of the limb end. When the limb 17 is inserted to the predetermined extent, so that the recess 23 appears in front of the blind bore 18, the ball 19 is brought into forced engagement with recess 23, thus providing the click stop action. In this way, the inserted end of the limb 17 can be stably held within the limb reception space 16.

As has been made apparent, the demountable archery bow according to the invention can be readily and reliably assembled by merely inserting the limbs into the respective limb reception spaces provided in the handle by virture of the click stop mechanism provided between the limb reception space and limb. Also, in case of replacing the limbs with others having a different length or strength the assembly and disassembly may be simply and easily accomplished without requiring any tool or added component.

Figure 4:
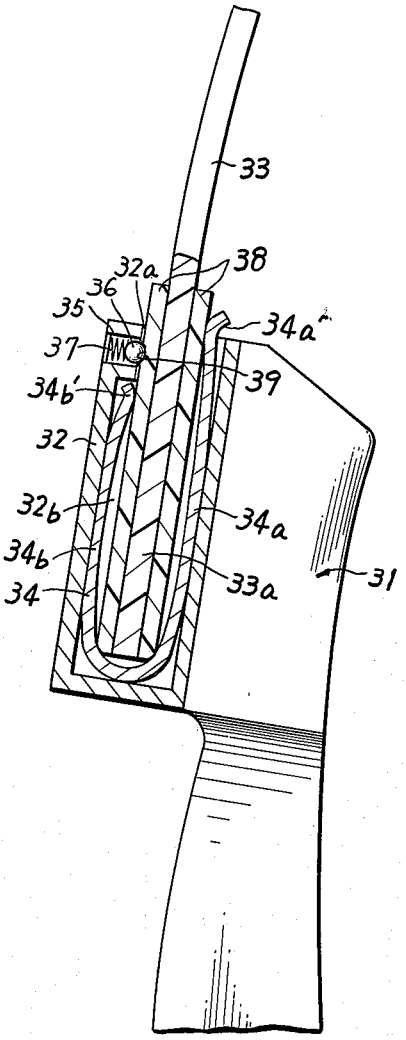
FIG. 4 is a view similar to FIG. 2 but showing a different embodiment of the invention.

FIG. 4 shows an enlarged-scale sectional view of the juncture between limb and handle end of another embodiment of the invention. In FIG. 4, element 31 is a handle, which is provided at each end on the front or target side thereof with a limb receptacle 32 secured to the handle by screws (not shown). The limb receptacle 32 is a rectangular hollow body made of a material such as an aluminum alloy, and it has an opening or mouth 32*a* formed at one end thereof for the insertion of a limb. Each limb 33 may be removably inserted through the opening 32*a* into the limb reception space 32*b* of each limb receptacle 32.

Within the limb reception space 32*b* is provided a substantially U-shaped plate spring 34 having opposing leg portions 34*a* and 34*b* in forced contact with respective rear and front inner walls of the limb receptacle 32, with the free ends 34*a'* and 34*b'* of the leg portions 34*a* and 34*b* being disposed on the side of the limb insertion opening 32*a*. The free ends 34*a'* and 34*b'* are spaced apart by a distance sufficiently smaller than the thickness of the insertable end 33*a* of the limb 33.

The limb receptacle 32 has a recess or blind bore 35 open to the limb reception space 32*b* at a location adjacent to the limb insertion opening 32*b*. A ball 36 is fitted in the bore 35 and is spring biased by a spring 37 also disposed within the bore 36, toward the limb reception space 32*b* such that it projects into the space 32*b*, thus constituting the so-called click stop mechanism.

The insertable end of each limb 33 is provided on both front and rear sides with synthetic resin pads or protectors 38 applied to it. The pad 38 on the side of the ball 36 is formed with a semi-spherical click stop recess 39. The recess 39 is provided at such a location that when the limb 33 is fully inserted into the limb reception space 32*b*, the limb is adapted to be locked due to the falling of the ball 36 into the recess.

It will be seen that the insertable end 33*a* of the limb 33 is inserted into the limb reception space 32*b* for assembling the archery bow, the free ends 34*a'* and 34*b'* of the plate spring leg portions 34*a* and 34*b* are pushed outwardly by the pads 8 provided on the limb end 33*a* to permit the intrusion of the end 33*a* into the space between the leg portions 34*a* and 34*b*. When the limb end is completely inserted into the limb reception space 32*b*, the ball 36 is brought into forced engagement with the recess 39 formed in the pad 36, thus providing the click stop action. At this time, the inserted end 33*a* of the limb 33 is clamped between the plate spring leg portions 34*a* and 34*b*, so that it is rigidly and stably joined to the handle 31.

Figure 5:
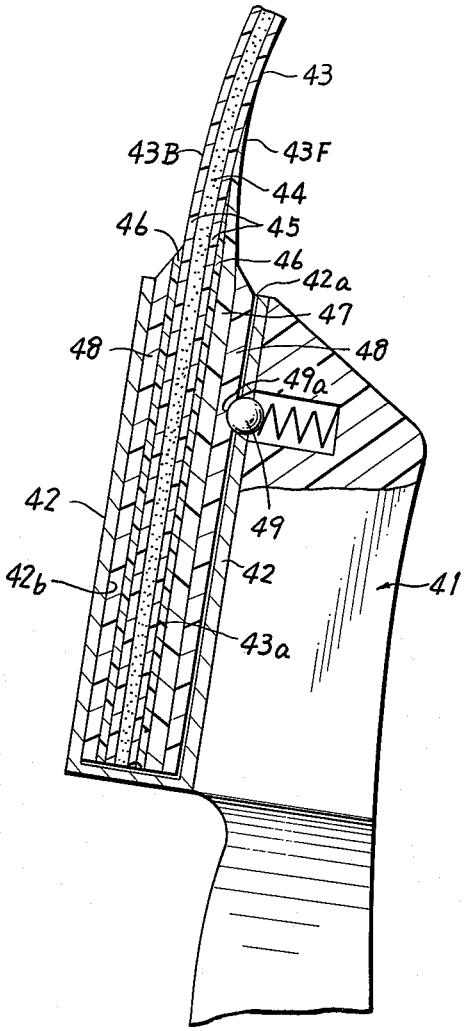
FIG. 5 is a view similar to FIG. 2 but showing a further embodiment of the invention.

FIG. 5 shows an enlarged-scale sectional view of the juncture between limb end and handle of a further embodiment of the invention. In FIG. 5, element 41 is a handle, which is provided at each end on the front or target side thereof with a limb receptacle 41 secured to the handle by screws (not shown). The limb receptacle 42 is a rectangular hollow body made of a material such as an aluminum alloy, and it has an opening 42*a* formed at one end for insertion of the limb. Each limb 43 has an insertable stem 43*a*, which is removably inserted through the opening 42*a* into the limb reception space 42*b* of each limb receptacle 42.

The limb has a laminated structure consisting of a wooden or bamboo core 44 and FRP sheets 45 bonded to both front and rear sides of the core. The insertable stem 43*a* of the limb 43 at one end thereof is formed by affixing shock absorption layers 46 by means of adhesive to the respective sheets 45, bonding a reinforcement FRP layer 47 to the shock absorption layer 46 on the rear or face side 43F of the limb 43 and further bonding outer protective layers 48 of a material such as ABS resins to both the FRP layer 47 and the shock absorption layer 46 on the front or target side 43B. The thickness of the face side shock absorption layer and reinforcement FRP layer is reduced toward the knock end to provide a comparatively gently curved profile for their portions extending from the opening 42*a* of the limb receptacle 42.

The protective layer 48 on the face side 43 F of the limb is formed with a semi-spherical recess 49a for receiving a click stop ball 49 of a click stop mechanism similar to that in the previous embodiments.

Figure 6:
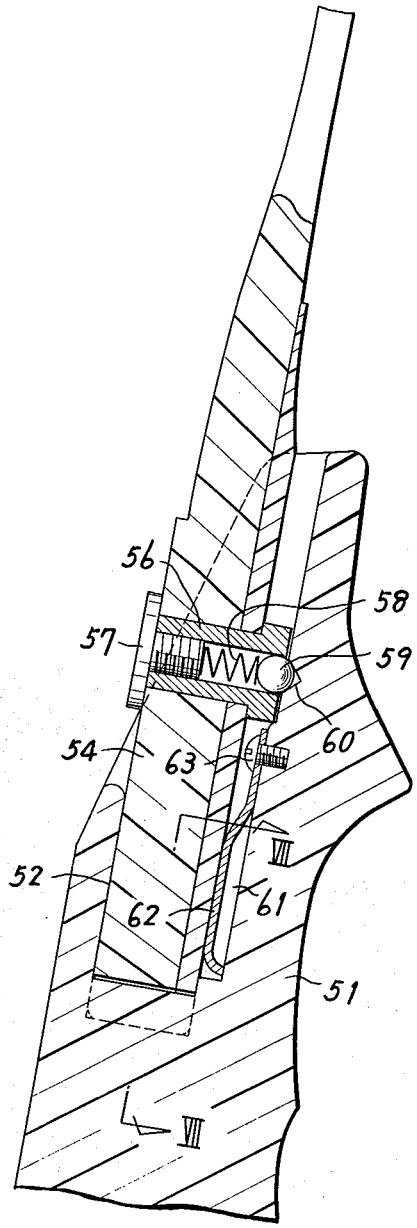
FIG. 6 is an enlarged-scale sectional view showing a further embodiment of the invention.
Figure 7:
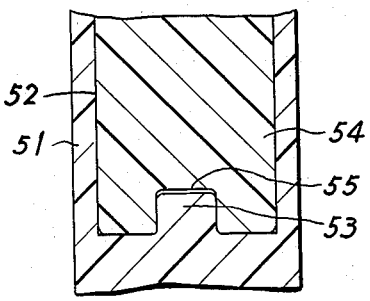
FIG. 7 is a sectional view taken along line VII—VII in FIG. 6.

FIGS. 6 and 7 show enlarged-scale sectional views of the juncture between limb end and handle of a further embodiment of the invention. Element 51 in FIG. 6 is a handle, which is provided at each end with a recess or limb reception space 52. The bottom of the recess 52 is provided with a protuberance 53, which is adapted to engage with a recess 55 formed at the end of the limb 54 when the limb is fully inserted into the limb reception space.

The insertable end portion of the limb 54 is provided with an internally threaded sleeve 56 penetrating the limb in the front-to-rear direction. A threaded portion of a cap member 57 is screwed into the sleeve 56. A ball 59 is fitted in the sleeve 56 and spring biased by a spring 58 disposed within the sleeve 56, while the handle 51 is formed in the base portion at a position thereof corresponding to the ball 59 with a click stop recess 60. In this way, a click stop mechanism is provided. Further, the base portion of the handle 51 is formed with a stepped portion 61, and a plate spring 62 is secured by a screw 63 to the stepped portion 61. The plate spring 62 serves to urge the limb 54 toward the other side, so that the limb end may be stably held within the limb reception space.

Figure 8:
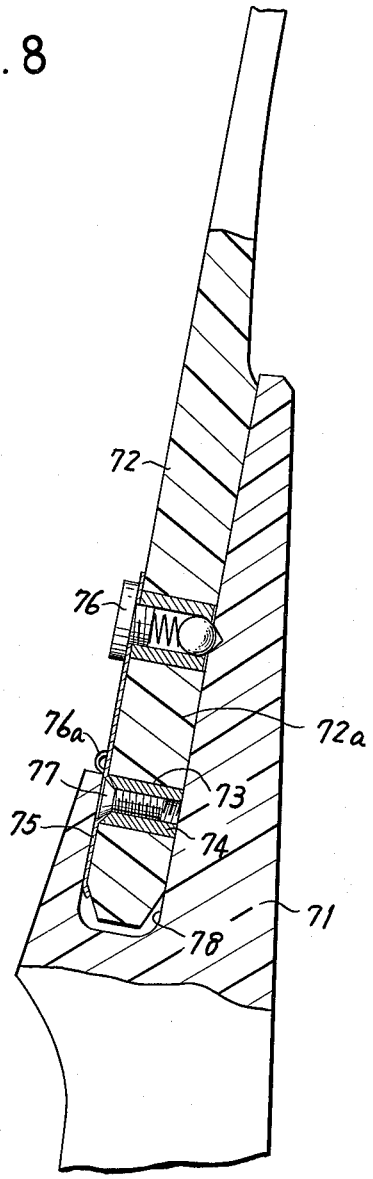
FIG. 8 is an enlarged-scale sectional view showing a further embodiment of the invention.

FIG. 8 shows an enlarged-scale sectional view of the juncture between limb end and handle of a further embodiment of the archery bow according to the invention. Here, parts which are the same as those in the preceding embodiment are not described. The insertable end 72*a* of the limb 72 is formed with a bore 73, and an internally threaded sleeve 74 is fitted in and secured to the bore 73. Element 75 is a plate spring affixed to the insertable end 72*a* of the limb 72. The plate spring 75 is provided with a central protuberance 76 serving as stopper, and it is fixed by a cap means 76 of the click stop mechanism and substantially at its center by a screw 77 screwed into the sleeve 74. By the plate spring 75, the limb 72 is urged against the opposite side so that it can be stably held within the limb reception space 78.

I claim:

1. A demountable archery bow comprising a handle, said handle having opposite ends and being provided with receptacles at said ends, limbs mountable in respective said receptacles, a plate spring mounted on one of said limbs extending in part within said corresponding receptacle between said handle and said one of said limbs to stabilize the mounting of said one of said limbs, click stop means connecting said spring plate to said one of said limbs at a position spaced from its associated receptacle and for locking at least one of said limbs releasably in the corresponding receptacle, a string extending between said limbs for being stretched to impel an arrow and, upon being stretched, imparting a stress through said plate spring into said handle, and fastener means securing said plate spring on said one limb at a position within its associated receptacle on that face thereof which is urged against the receptacle by the stretching of said string.

2. A demountable archery bow as claimed in claim 1 wherein said click stop means is mounted on said one of said limbs and said handle is provided with a recess to cooperate with the click stop means.

3. A demountable archery bow as claimed in claim 1 wherein said click stop means includes a sleeve, a ball in the sleeve, a spring in the sleeve loading said ball, and cap means to engage said latter mentioned spring.

4. A demountable archery bow as claimed in claim 1 comprising a protuberance on the plate spring to limit penetration of said one of said limbs into said corresponding receptacle.

* * * * *